United States Patent [19]

Pearson et al.

[11] 4,297,870

[45] Nov. 3, 1981

[54] HYDRAULIC PRESS WITH INTEGRAL KNOCKOUT AND STROKE CONTROL

[75] Inventors: Eugene W. Pearson, Orinda, Calif.; Wilbur G. Short, Browns, Ill.

[73] Assignee: Canron Corp., Oakland, Calif.

[21] Appl. No.: 19,184

[22] Filed: Mar. 9, 1979

Related U.S. Application Data

[62] Division of Ser. No. 875,353, Mar. 20, 1978, Pat. No. 4,242,901.

[51] Int. Cl.[3] ..... B21J 7/46

[52] U.S. Cl. ..... 72/443; 72/453.01

[58] Field of Search ..... 72/345, 443, 453.01, 72/352; 100/269

[56] References Cited

U.S. PATENT DOCUMENTS

| | | | |
|---|---|---|---|
| 1,773,908 | 8/1930 | Knowlton | 72/443 X |
| 2,486,844 | 11/1949 | Herrick | 72/443 X |
| 2,861,486 | 11/1958 | Brauer | 72/443 |
| 2,916,987 | 12/1959 | Hanni | 100/295 UX |
| 3,031,903 | 5/1962 | Billen et al. | 72/443 |
| 3,827,328 | 8/1974 | La Flamme et al. | 72/443 |

*Primary Examiner*—Leon Gilden

*Attorney, Agent, or Firm*—Edward Brosler; Merwyn G. Brosler

[57] ABSTRACT

A press, comprising a frame supporting an upper and lower bed for attachment of an upper and lower bolster, the upper and lower bolster each carrying mating halves of a complementary die, and the upper bolster having a knock-out opening therethrough, a hydraulic knock-out means carried by a drive means above the upper bolster that is adjustably electro-mechanically timed to cooperate with pins internal to the upper bolster to eject any work that may have remained in the upper die upon separation of the two mating die halves.

6 Claims, 6 Drawing Figures

HYDRAULIC PRESS WITH INTEGRAL KNOCKOUT AND STROKE CONTROL

This is a division of application Ser. No. 875,353, filed Mar. 20, 1978 now U.S. Pat. No. 4,242,901.

My invention relates to ram-type machines, such as press brakes and the like, and more particularly, though not limited to, one of the straight side type, where a ram carrying one-half of a die is guided by corner columns in its advance toward the complementary die half, to produce work on any material placed therebetween.

Machines of this type generally have means for ejecting or knocking out the formed material from the upper die half upon the ram returning to the uppermost limit of its stroke. The formed piece must then fall and be removed from between the dies and another piece of material inserted before another work stroke can begin.

It can be seen that this operation would proceed more efficiently and swiftly if the formed work could be conveniently and easily removed at the earliest possible time after the forming process is complete and the return stroke started.

Also, it has been found that the speed of the ram necessary for the work operation need not limit the speed of the ram during other phases of its cycle. For example, the advance of the ram toward the material may advantageously be faster than the slower ram speed during the performance of work on the material. The return stroke also may advantageously be faster. A ready means for controlling the ram speed at various phases of the ram cycle could enhance productivity by making it simple and easy for an operator to alter settings dependent upon the material being worked.

Among the objects of my invention are:

(1) To provide a novel and improved knockout means for a hydraulic press;

(2) To provide a novel and improved knock-out means for a hydraulic press, the activation of which is readily timed;

(3) To provide a novel and improved knockout means for a hydraulic press that is operated hydraulically;

(4) To provide a novel and improved knockout means for a hydraulic press, the duration of activation of which is readily and adjustably timed;

(5) To provide a novel and improved hydraulic press with a multi-speed slide system;

(6) To provide a novel and improved press with a multi-speed slide system having a fast advance speed readily adjustable in inches of movement at the various speeds;

(7) To provide a novel and improved press whose drive means include a cylinder movable about a fixed piston.

Additional objects of the invention will be brought out in the following description of the same, taken in conjunction with the accompanying drawings, wherein FIG. 1 is a front view in elevation of the invention with a front panel cut away to partially expose the knock-out and drive means;

Figure 1:
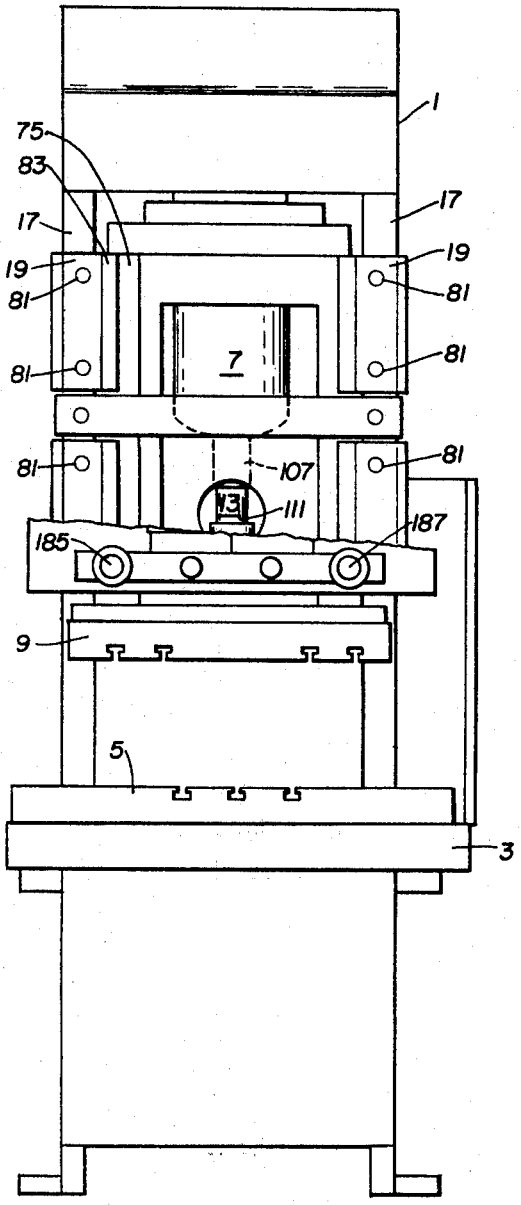
Figure 2:
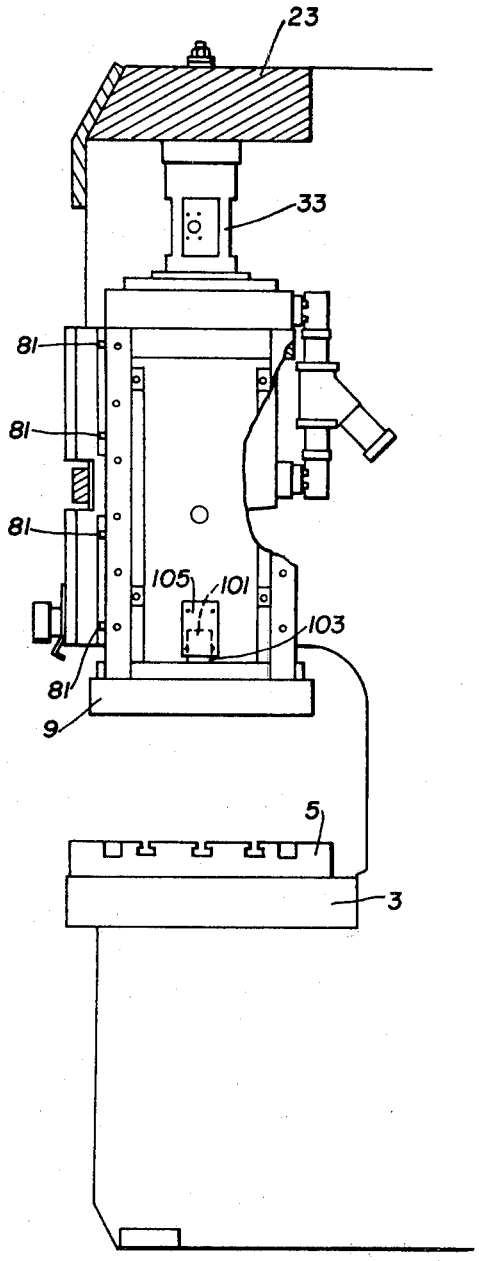
FIG. 2 is a side view in elevation of the invention of FIG. 1.
Figure 3:
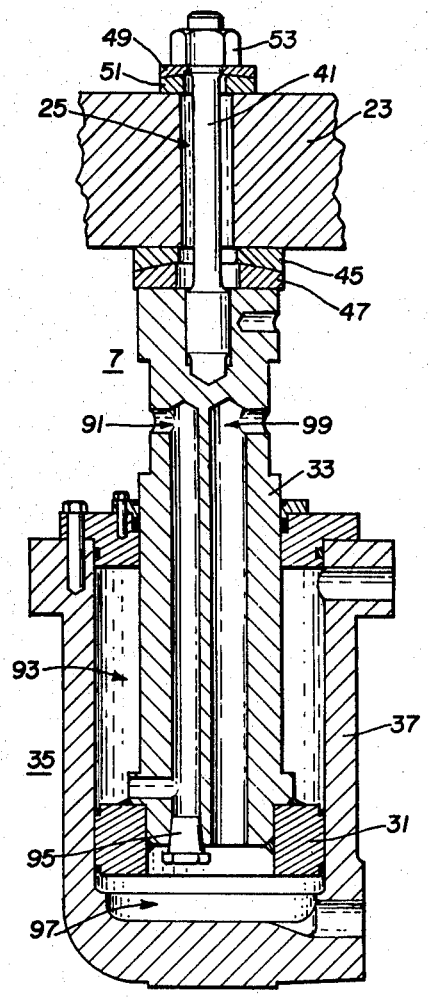
FIG. 3 is a side view in section of the drive means of the invention in FIG. 1.
Figure 4:
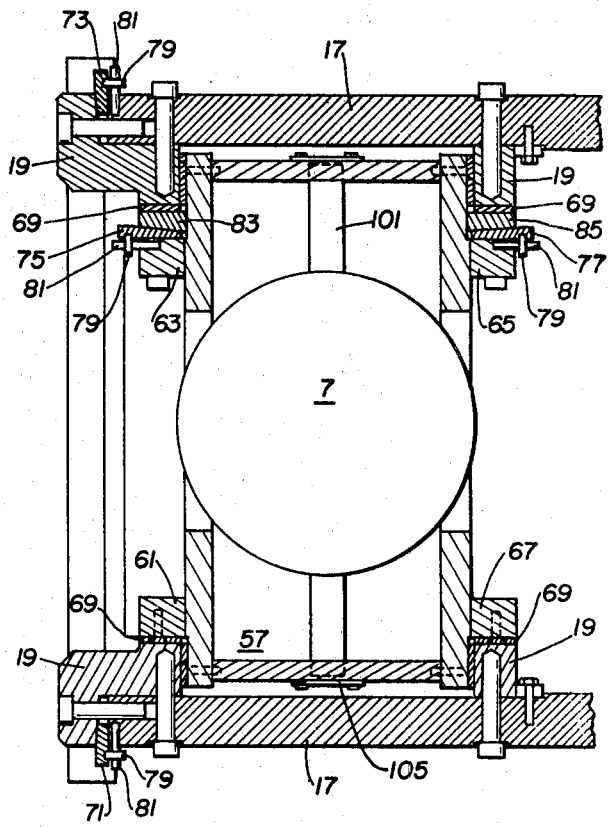
FIG. 4 is a plan view in section depicting the slide and gibbing arrangements of the invention.

Referring to the drawings for details of the invention in its preferred form, the invention is disclosed as embodied in a press of the type having a frame 1 including a bed 3, a bolster 5 on the bed for holding one of a pair of complementary dies (not shown), reciprocal drive means 7 for producing a work stroke and a return stroke supported by the frame above the bed for carrying a bolster 9 to which may be affixed the other of such complementary dies (not shown), the latter bolster having at least one knock-out opening 11 therethrough (FIG. 5), knock-out means 13 carried by the drive means above the latter bolster for use in conjunction with the knock-out openings, and means for actuating the knock-out means during the initial portion of a return stroke of the drive means.

The frame also includes side housings 17 supporting slideways 19 for guiding reciprocal movement of the drive means, and across the top, spanning the two side housings, is a frontally located cross member 23 having a centralized opening 25 therethrough.

Installation of the knockout means directly to the drive means requires more space than heretofor found necessary in conventional systems. Applicant finds that by inverting the drive means 7, comprising a piston 31 and cylinder 35, attaching the free end of a piston rod 33 to the frame, making the cylinder slidable about the piston and attaching the knockout means to the cylinder, provides the space necessary for the knockout means without unduely heightening the press. The free end of the piston rod is alignably installed to the cross member by means of a heavy threaded rod 41 through the centrally located opening, one end threaded into the piston rod end and the other secured through the opening in the cross member, such opening being larger in diameter than that of the rod to allow for angular and longitudinal adjustment of the rod within the opening.

Surrounding the heavy threaded rod, between the cross member bottom and the piston rod, is a pair of adjustment washers 45, 47. The non-contacting surface of each is planar, and of the contacting surfaces, one is concave and the other convex. The adjustment washers each contain aligned openings of approximately the diameter of the opening 25 through the cross member 23 to enable them to be adjusted laterally with respect to each other. A similar but smaller set of adjustment washers 49, 51 is located under a nut 53 securing the rod and drive assembly to the cross member.

Together, this alignment system including both sets of alignment washers, permit angular as well as longitudinal adjustment of the supported drive assembly.

The cylinder housing 37 is surrounded by a rectangular frame assembly 57, solid on two sides and open front and back. The frame is secured to the cylinder housing, preferably by welds, and extends below the housing to support the upper bolster 9.

The frame assembly includes vertical members 61, 63, 65, 67 near each corner which, together with the sides of the rectangular frame which, when provided with a slide liner 69 the full length of the frame, are complementary to the opening formed by the slideways 19. The frame assembly will thus be guided within the slideways during operation of the press.

To enable alignment for permitting accurate mating of the two die halves, the drive means may be adjusted within the slideways by means of an adjustable jib assembly. Such assembly includes a left and right front jib 71, 73 and a left front and left rear jib 75, 77. Each jib is wedge-shaped and includes a small slot near its wide end to receive a knurled nut 76 movable with the adjustment of an adjacent set screw 81, such that when the set screw is moved, the jib moves accordingly.

Jibs are imposed between the left front and rear vertical members 63, 65 and slide bars 83, 85 attached to the vertical members by means of cap screws through openings in the members and the jibs. This provides lateral adjustment possibilities for the drive assembly by adjustment of set screws to insert or withdraw the jibs.

A jib is also inserted between the left and right front slideways and the side housing to allow for a similar front and back adjustment of the left and right front slideways.

The non-movable piston rod 33 and piston 31 attached to the upper cross member, include internal passageways to provide for fluid flow to either side of the piston to actuate the cylinder. This method is used to prevent major movement of connecting lines to the cylinder housing that would otherwise be necessary if conventional methods were utilized.

A first passageway 91 through the cylinder rod provides access to a first chamber 93 created within the cylinder housing by the piston itself. A plug 95 separates this passageway from a second chamber 97 and closes an opening created during construction. A second passageway 99 provides direct access to the second chamber.

Fluid under pressure entering this second passageway enters directly into the second chamber and bears against the inner wall of the lower cylinder and the piston surface, driving the cylinder downward.

Driving the cylinder upward is accomplished by supplying fluid through the first passageway into the first or upper chamber, developing pressure between the upper piston surface and the inside of the upper cylinder housing.

The bolster is provided internally with knockout pins (not shown) in alignment with knockout openings in the associated die. These knockout pins are activated by a knowckout bar 101 slidably secured within the movable frame above the upper bolster. This knockout bar is guided in a slot 103 created by an opening in the solid sides of the rectangular frame that is covered by a small rectangular plate 105 after the bar is inserted.

Activation of the knockout bar is accomplished by means of the knockout cylinder assembly comprising a cylinder housing 107 supported under the drive means and enclosing a slidable piston 109 with an attached rod 111 that approaches the knockout bar, such that activation of the piston enables the piston rod to strike the knockout bar which, in turn, strikes the knockout pins within the bolster and ejects any material that is held within the upper die.

It should be noted at this point that this hydraulic knockout cylinder and the knockout bar are completely enclosed within the slide structure and not exposed to an operator to create a hazard, as is normally found in the traditional knockout means where external adjustments are necessary. It will be shown how the adjustment to select the point of knockout may be simply accomplished without exposure of any danger to an operator.

Figure 5:
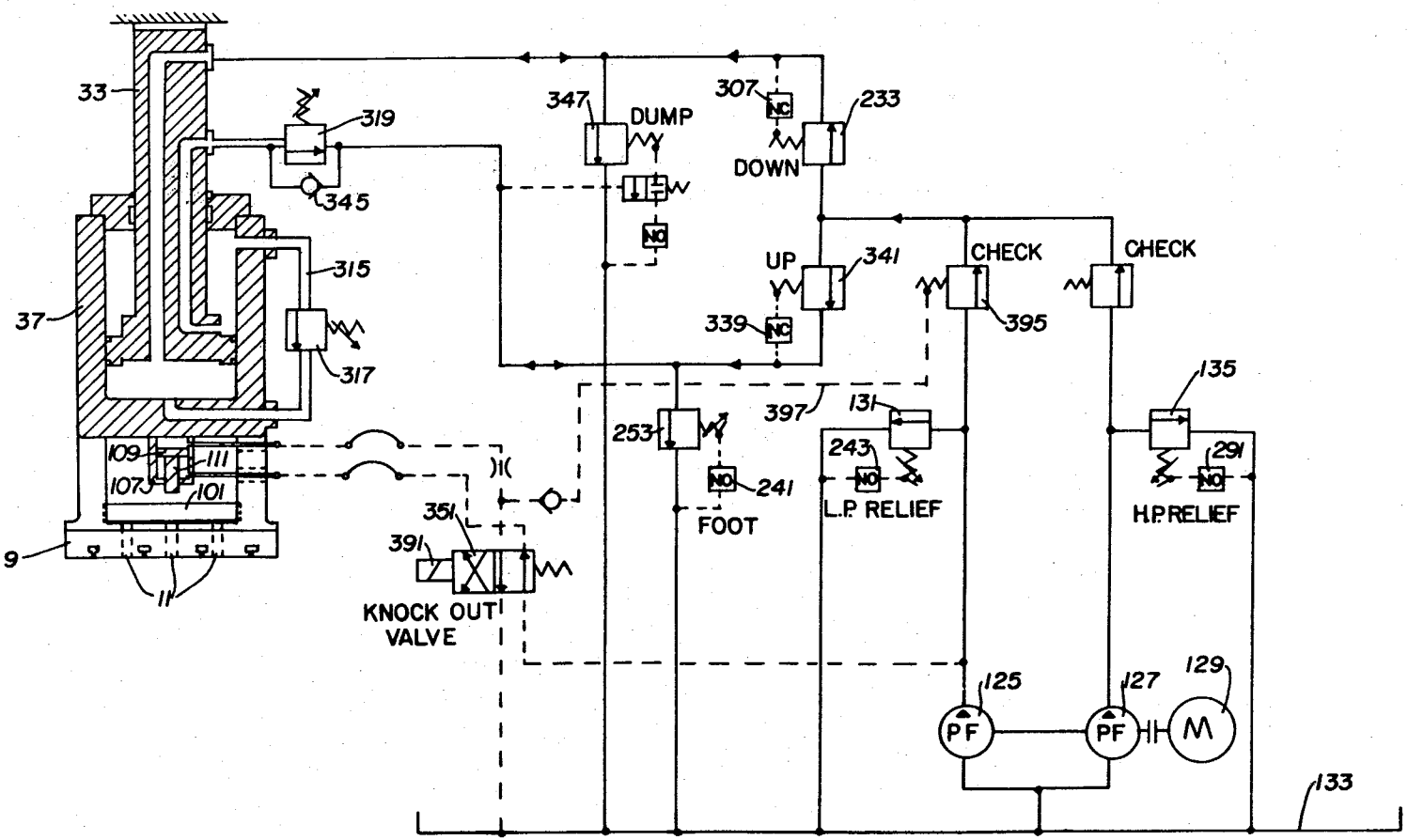
FIG. 5 is a circuit schematic depicting the hydraulic operation of the invention.
Figure 6:
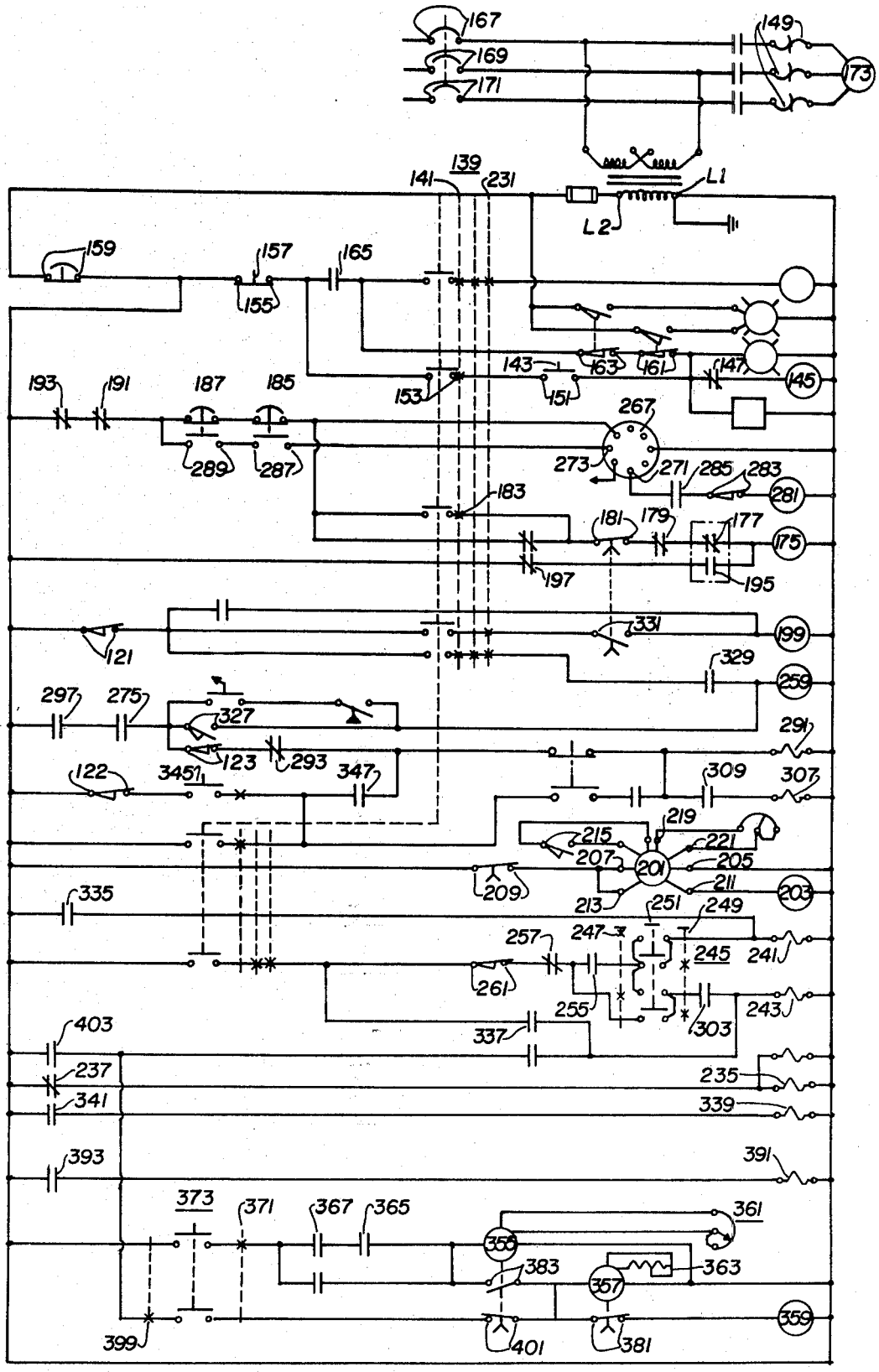
FIG. 6 is a circuit schematic depicting the electric sequence control of the circuit of FIG. 5.

The operation of the press is sequenced by an electrical circuit such as that depicted in FIG. 6 in conjunction with a hydraulic circuit such as shown in FIG. 5, where the hydraulic valves used are similar to those described in a pending application of Wilbur G. Short for a "Front Operated Rake Adjustment Assembly" filed Mar. 11, 1977 and given Ser. No. 776,634.

The stroke of the ram may be controlled by an adjustable upper limit switch and an adjustable lower limit switch each adapted to be engaged by a stop mounted on the ram (not shown). Contacts 121, 123 of such limit switches are depicted in the circuit diagram.

The hydraulic circuit is capable of delivering fluid to the drive means at different velocities to enable the press to operate at different speeds during different phases of its operating cycle. These velocities are achieved by two pumps 125, 127 connected in parallel and driven by the same motor 129. In circuit with one pump 125 is a pilot operated low pressure relief valve 131, which when not actuated, directs fluid from the pump back to a reservoir 123. When activated, however, this valve maintains a low pressure in this line. A similar process occurs with the other pump 127 except that a relief valve 135 in this line, when activated, maintains a higher pressure.

When at idle, neither the high pressure relief 135 valve nor the low pressure relief valve 131 are actuated and fluid flows from the reservoir, through both pumps and back to the reservoir. Either relief valve, activated alone, causes fluid to flow at a different velocity within the hydraulic circuit to which it is connected. When activated together, fluid flows in the circuit at a higher velocity than either alone and provides for faster movement of the drive cylinder 37.

Sequencing of the pilot operated valves within the system is controlled electrically, first by bringing the press up to an idle condition. This is accomplished by first turning a "mode-selector" switch assembly 139 to a first position 141, causing the completion of the contacts shown in the circuit for this position.

Depression of a "motor-start" button 143 now, completes circuit from the power source L1, through a main "motor starter" 145, normally closed contacts 147 of a motor overload relay 149, through the "motor start" button contacts 151, "mode selector" switch contacts 153, normally closed contacts 155 of a "motor stop" button 157 and "emergency stop" button contacts 159 to the power source L2. The "motor starter" will hold through a circuit bypassing the "motor start" button 143 and the "mode selector" switch contacts 141, and which includes normally closed secondary contacts 161, 163 of upper and lower limit switches which are acutated if the primary contacts 121, 123 fail. In this holding circuit also are now closed contacts 165 of the motor starter itself. The "motor starter" now closes contacts 167, 169, 171 across a decreasing resistance in each of three alternating current phases to bring a motor 173 up to full speed.

A "single stroke" relay 175 is now actuated by a circuit from the power source L1 through the coil of the relay, through normally closed contacts 177 of the relay itself, normally closed contacts 179 of an "anti-tie-down" relay, contacts 181 of a "depth" limit switch, contacts 183 of the "mode selector" switch, contacts 185, 187 of a pair of "run" buttons, normally closed contacts 191 of a "return" relay and normally closed contacts 193 of a "knockout" relay back to the power source L2.

This "single stroke" relay is held through a now closed set of its own contacts 195 and a normally closed set of contacts 197 from a "return" relay 199.

At this time it should be noted that a "rapid advance" timer 201 and relay 203 are activated and remain so as long as the drive means 7 is at the upper limit of the stroke and the upper limit switch 215 is closed. This is accomplished by timing relay 201 similar to that produced by Bulletin, No. 852S, where the relay is continually energized through a path from power source L1 through relay contacts 205, 207, and contacts of a pressure switch 209 back to the power source L2. The relay is utilized for off delay timing where the output contacts 211, 213 provide a circuit for the rapid advance relay 203 which de-energizes at an adjustable time after the input is removed. In this instance, input is provided by the closing of contacts 215 of the upper limit switch which are closed as long as the drive means is at the top of its stroke and is removed when the drive means leaves this position. The time delay period is externally adjustable by means of a variable patentiometer 217 connected across contacts 219, 221 and which is physically located on a panel 233 on the outer surface of the machine which is readily accessible to an operator, and may be calibrated in inches or millimeters of stroke rather than in seconds or milliseconds.

Functionally, as long as the drive means is at the top position of its stroke, the "rapid advance" relay 203 is activated, and remains so for an adjustable period of time, which represents inches of stroke, after the stroke has been initated and the input limit switch contacts to the "rapid advance" timer 201 have been opened.

After the motor 173 is up to speed and the "single stroke" relay 175 has been activated, the "mode selector" switch assembly 139 may be advanced to a "single stroke automatic return" position 231 and the following description will apply.

During normal idling of the press, a dump voltage 223 is opened to expose the first drive cylinder chamber to atmosphere by actuating the dump solenoid 235 by a circuit through the solenoid, normally closed contacts 237 of the "return" relay, and back to the power source L2.

Utilized in the circuit in connection with a "foot" valve pilot 241 and the "low pressure relief" valve pilot 243 is a three position key switch 245 for selecting the advance speed combinations to be used advancing the ram toward the material and speed during pressing of the material. It will be shown how contacts associated with a first position 247 of the switch are in circuit with the "foot" valve pilot 241 during a rapid advance speed slowing to a normal pressing speed while contacts associated with a third position 249 are in circuit with the "foot" valve pilot and the low pressure relief valve pilot 243 activated during a rapid advance speed changing to a fast pressing speed. In the second, or off position 251 the advance and pressing speed is normal pressing speed for the whole stroke.

During idle, the "foot" valve 253 is actuated by activating the "foot valve" pilot 241 from a circuit from the power source L1 through the solenoid, contacts of the three position "advance speed" selector switch 245, where the first or third position 247, 249 is selected, through now closed contacts 255 of the rapid advance relay 203, normally closed contacts 257 of a depth relay 259, closed contacts of the lower limit switch which will protectively break the circuit if the drive means reaches its lower limit, the "mode selector" switch contacts and back to the power source L2.

The above condition described the press at a cycled up idle condition with the drive means at the top of the stroke.

Initiating a work cycle involves an operator depressing two spaced apart run buttons 187, 185 simultaneously to insure that his hands will not be caught in any moving parts of the press. This is accomplished with an "anti-tie-down relay" 267 in circuit with the two push buttons. The relay is a fixed timing device which starts timing when the contacts of either push button is opened and completes a circuit from pins 271 to 273 is the other push button is depressed prior to the expiration of the fixed timing. Both push buttons must be continuously held to maintain the circuit. This relay is equivalent to one produced by Potter and Brumfield of Princeton, New Jersey, part No. CZ-430-2.

With both "run" button simultaneously depressed, a drive "down" relay 281 will be activated through a circuit from the power source L1, through the relay coil, contacts 283 of the adjustable lower limit switch, now closed contacts 285 of the single stroke relay, now closed contacts 271, 273 of the "anti-tie-down relay", held closed contacts 287, 289 of the "run" buttons, normally closed contacts 191, 193 of the knock-out and return relay, and back to the power source.

The high pressure relief valve solenoid 291 will be activated through a circuit from the power source, the solenoid, normally closed contacts 275 of the depth relay 259, contacts 123 of the lower limit switch, now closed contacts 275 of the "down" relay 281, now closed contacts 297 of the "single stroke" relay 175, and back to the power source. This activates the high pressure relief valve 135 and allows fluid under pressure into the hydraulic circuit.

With the "advance speed" select switch in the first or third position for indicating a rapid advance, the low pressure pump 125 is added to the circuit by activating the low pressure relief valve pilot 243 through a circuit from the power source through the pilot, the now closed contacts 303 of the "down" relay 281, "advance speed" selector switch contacts, timed contacts 255 of the "rapid advance" relay for controlling rapid advance duration, normally closed contacts 257 of the depth relay, contacts 261 of the lower limit switch, contacts of the mode selector switch and back to the power source.

The "down" valve 233 directs fluid to the second cylinder chamber to drive the cylinder down, and is actuated through a circuit from the power source, through the "down" pilot 307, now closed contacts 309 of the down relay 281, normally closed contacts 293 of the depth relay, closed contacts 123 of the lower limit switch, now closed contacts of the "down" and "single stroke" relays, and back to the power source.

The "foot valve" pilot 241 remains activated through the circuit above described.

With the circuit as thus described, fluid enters the area between the stationary piston and the movable lower cylinder wall through the cylinder rod passageway by way of the "down" valve, and is supplied by both pumps, causing the cylinder to move downward at a fast advance speed.

As this cylinder move downward, fluid from the area above the piston and the upper cylinder, is directed through a passageway 315 containing a check valve 317 having an adjustable resistance, and into the second chamber to again assist speeding the advance of the cylinder. Overflow from the first chamber is directed through a "counter-balance" valve 319, the "foot"

valve 253, and back to the reservoir. This rapid advance continues until the selected timing of the rapid advance timing relay 201 runs out and the rapid advance relay contacts 211, 213 open, deactivating the "foot" valve and low pressure relief valve pilots 241, 243, removing the assistance of the low pressure pump and decreasing the resistance from the second chamber to the reservoir through the "foot" valve 253.

At this point, fluid passes through the high pressure pump 127, the "down" valve 233, the second passageway in the piston rod and piston into the second chamber to drive the cylinders downward at a slow or normal pressing speed. The fluid in the first chamber is exhausted through the first passageway in the piston rod, through the counter balance valve, the foot valve and back to the reservoir.

When working with lighter materials, this slower pressing speed is not always necessary and the work can be preformed at a speed faster than the normal pressing speed yet slower than the rapid advance speed. To this end a faster pressing speed is obtained by moving the "speed" selector switch to the third position where the lower pressure relief valve solenoid 243 will be activated through a path from the power source, through now closed contacts 303 of the "down" relay, through third position switch contacts, normally closed contacts of the depth relay 257, closed contacts 261 of the lower limit switch, through the mode select switch and back to the power source. We now have a condition where we are receiving fluid from both pumps and the "foot" valve 253 passes fluid to the reservoir at a lower pressure.

At the bottom of the stroke, after pressing has been completed, the "depth" relay 259 is activated by the closing of contacts 327 on a bottom limit switch to provide a circuit from the power source through contacts of the lower limit switch, now closed contacts 275, 297 of the down relay and the single storke relay, and back to the power source. This relay has a holding path through an instantaneous set of contacts 329 of its own, contacts of the mode selector switch, closed contacts 121 of the upper limit switch and back to the power source. The selection of the depth relay, causes timed contacts 181 to open deactivating the "single stroke" relay 175, and another set of timed contacts 331 to close allowing a circuit to activate the "return" relay 199 from the power source through the relay, timed contacts 331 of the "depth" relay, the "mode selector" switch, contacts 121 of the upper limit switch, and back to the power source.

Selecting the "return" relay, provides a circuit for the "foot valve" pilot 241 from the power source through the pilot, now closed contacts 335 of the "return" relay, and back to the power source. The low pressure relief valve pilot will also be selected at this time through a circuit from the power source to the pilot, now closed contacts 337 of the "return" relay, contacts of the "mode select" switch, and back to the power source.

An "up" valve pilot 339 is also selected at this time to actuate an "up" valve 341 to provide a path for directing fluid to the first chamber in the drive cylinder. This pilot is activated through a circuit from the power source through the "up" valve pilot, now closed contacts 341 of the "return" relay 199 and back to the power source.

In this condition, hydraulic fluid is supplied at low pressure through the "up" valve 341, prevented from returning to the reservoir due to the activation of the "foot" valve 253, through a check valve by-pass 345 around a counter-balance valve 319, and into the first chamber of the drive cylinder applying pressure between the upper cylinder housing and the stationary piston moving the cylinder upward. Fluid in the second chamber is exhausted through the second passageway, the unselected "dump" valve 223 and back to the reservoir.

The piston will continue upward at this normal speed until the upper limit switch contacts 121 are opened deactivating the return relay 199 which opens contacts in circuits for the low pressure relief valve pilot 243 and the "up" valve pilot 339 halting upward movement of the cylinder.

To provide for a fast return speed, a keyed switch 345 of a conventional type, is turned to a position which completes a circuit through the high pressure relief valve pilot 291 at the time the return stroke is started. This circuit is completed from the power source through the high pressure relief valve pilot, through now closed contacts 347 of the return relay 199, the keyed switch 345, closed contacts 122 of the upper limit switch, and back to the power source. This provides fluid from both the high pressure source and the low pressure source to assist in driving the cylinder upward at a faster return speed.

It can now be seen, how with the various combinations of positions of external switches, the press can be conditioned to rapidly advance toward the work and press at either a normal or fast speed, and then return at either a normal or fast speed.

To facilitate removal of any material that may have remained in the upper die upon separation of the two die halves, the knock-out cylinder 13 is capable of being actuated at an adjustable distance from the lower or bottom position of the drive means as the return stroke is started.

The knock-out circuit involves a pilot activated directional knock-out valve 351 which controls fluid to and from the knock-out cylinder 107. It should be noted at this point that a preferred embodiment of the knock-out cylinder includes a fluid passageway to both above and below the piston 109. A second embodiment might include a fluid passageway above the piston with a return spring (not shown) in the chamber below. The circuit also includes a pair of time delay relays, a first 355 and a second 357, and an instantaneous knock-out relay 359. The time delay relays are similar to a type produced by Omnetics Inc., and given part No. NAR115 A5 Z.

Each of the time delay relays is supplied with an external variable potentiometer 361, 363 which controls timing of the closing of the contacts of the relay once the relay coil voltage has been applied. This occurs in a circuit from the power source, through the first time delay 355, now closed contacts 365, 367 of the depth relay 259 and the return relay 199, contacts 371 of a conventional key switch 373 controlling either manual or automatic eject in the automatic eject position, and back to the power source. Contacts 383 of this relay 355 are delayed in closing, and this period of time allows the drive position to return a certain distance before activation of the knock-out piston 109. The knock-out piston is activated from a circuit from the power source, through the knock-out relay 359, normally closed contacts 381 of the second time delay relay 357, delayed closing contacts 383 of the first time delay relay 355, the still closed contacts 365, 367 of the "depth" relay and the "return" relay, contacts 371 of the knock-out control switch, and back to the power source.

The delay of the second time delay relay controls the duration of operation of the knock-out piston. This occurs when the contacts of the first time delay relay 355 are closed providing circuit through the second time delay relay 357 from the power source through still closed contacts 365, 367 of the depth relay and return relay, the knock-out switch contacts 371 and back to the power source. At a pre-determined time as adjusted for by the external potentiometer 363, the normally closed contacts 381 of the second time delay relay 357 which are in the circuit with the knock-out relay 359, open to cause the knock-out relay to be deactivated.

This is reflected hydraulically by timing the selection and duration of activation of the knock-out valve assembly 13 by activating the knock-out valve solenoid 391 through a circuit controlled by contacts 393 of the knock-out relay 359.

This provides a means for delaying the knock-out of the material until the drive piston is a selected distance along on its return stroke, this distance being easily varied by an operator externally by adjusting an accessible potentiometer 361, which may be calibrated in inches or millimeters rather than time. And the duration of activation of the knock-out piston is also easily varied externally by an operator by adjustment of potentiometer 363, though generally it is not necessary to alter the set timing as it is independent of where knock-out occurs.

Hydraulically, when the knock-out relay 359 is activated, fluid from the low pressure pump 125 is directed through the knock-out valve 351 to the area above the knock-out piston 109, driving it down against the knock-out bar 101. Fluid from under the knock-out piston at this time is directed through the knock-out valve to the reservoir.

The low pressure pump 125 includes a check valve 395 which allows fluid to pass in only one direction. A constriction in the opening in the one direction is pressure controlled by a flow passageway 397 from the check valve to the "knock-out" cylinder side of the knock-out valve, such that when the knock-out valve is activated and pressure is seen at "the knock-out" cylinder, this pressure restricts the flow of fluid to the circuit controlling the drive piston, and allows more fluid to the knock-out cylinder. This is a momentary constriction only for the length of time "knock-out valve" 351 is operated.

With the "knock-out" switch 373 turned to a manual position 399, contacts 401 of the "rapid advance" relay 355 become included in a circuit which activates the knock-out piston at the top of the stroke. This circuit is from the power source through the "knock-out" relay 359, normally closed 381, 401 contacts of the first and second time delay relays, contacts 399 of the knock-out switch, contacts 403 of the rapid advance "relay", and back to the power source. This causes activation of the knock-out piston each time the drive cylinder reaches the top of its stroke.

It can thus be seen how simply and easily an operator can readily adjust the time of ejection of material from the die without having physically adjust a mechanical clamp that would normally be incorporated on a similar type press.

While we have illustrated and described our invention in its preferred form, it will be apparent that the same is subject to alteration, modification and additions without departing from the underlying principles involved, and we, therefore, do not desire to be limited in our protection to the specific details illustrated and described except as may be necessitated by the appended claims.

I claim:

1. A press comprising a frame including a bed, a bolster on said bed for holding one of a pair of complementary dies, reciprocal variable speed drive means for producing a work stroke and a return stroke supported by said frame above said bed for carrying a bolster to which may be affixed the other of said complementary dies, said drive means including a hydraulic piston/cylinder assembly for providing said work and return stroke, means for selecting various speed changes of said upper die during said work stroke and said return stroke and means for controlling the duration of said various speeds relative to time, whereby die travel at a specific speed is a function of time of travel at such speed.

2. A press in accordance with claim 1, characterized by said piston/cylinder assembly utilizing fluid to move said upper die with respect to said lower die at a rate determined by flow rate of said fluid, a reservoir for such fluid, a hydraulic circuit connecting said reservoir to said piston/cylinder assembly, conduit and valves connected in said circuit for controlling flow of such fluid to said piston/cylinder assembly, pressure developing means for delivering said fluid through said valves and conduits to said piston/cylinder assembly, said pressure developing means including a pair of pump assemblies in said hydraulic circuit between said pumps and said piston/cylinder assembly to apply pressure to such fluid, and external control means in circuit with each of said pump assemblies to control effective pressure contributed by each of said pump assemblies to said circuit, whereby, said external control means controls effective fluid pressure contributed from each of said pumps and therefore effective resulting flow rate within said hydraulic circuit.

3. A press in accordance with claim 2, characterized by said external control means including electrical pilot activated relief valves in by-pass relationship with each of said pumps, said relief valves when activated controlling pressure developed by each associated pump, one of said valves controlling high pressure and the other controlling low pressure, whereby, activation of one or the other or both of said valves enables three different fluid pressures and therefore three different fluid speeds within said hydraulic circuit.

4. A press in accordance with claim 3, characterized by an electrically sequenced circuit controlling activation of various combinations of said relief valves to provide various fluid speeds within said hydraulic circuit, said electrical circuit comprising means for selecting speed combinations to be used during said work stroke and said return stroke including means applying different speeds to said die when advancing to said work and when pressing said work, means providing selectable pressing speeds dependent upon material to be pressed, and each of said pressing speeds capable of being utilized in combination with said different advance speeds.

5. A press in accordance with claim 4, characterized by said press having a limit switch with closed electrical contacts in said electrical circuit when said drive means is at the top of its work stroke and said electrical circuit including means for adjustably timing said rapid advance based upon the opening of said contacts of said limit switch, said timing means including a time delay relay having input and output contacts, said input contacts in circuit with said limit switch contacts, said output contacts in circuit with a relay controlling one of said relief valve pilots, whereby, with one pump supplying fluid to said hydraulic circuit to drive said die, the other may contribute for a period equal to the duration of such adjustable time delay to provide for a rapid advance speed of said die.

6. A press in accordance with claim 1, characterized by an electrically sequenced circuit controlling activation of various combinations of said relief valves to provide various fluid speeds within said hydraulic circuit, said electrical circuit comprising means for selecting speed combinations to be used during said work stroke and said return stroke including means applying different speeds to said die when advancing to said work and when pressing said work, means providing selectable pressing speeds dependent upon material to be pressed and each of said pressing speeds capable of being utilized in combination with said different advance speeds.

* * * * *

UNITED STATES PATENT AND TRADEMARK OFFICE

CERTIFICATE OF CORRECTION

PATENT NO. : 4,297,870

DATED : November 3, 1981

INVENTOR(S) : Eugene W. Pearson et al.

It is certified that error appears in the above—identified patent and that said Letters Patent is hereby corrected as shown below:

Column 5, line 35, "voltage" should read --valve--.

Column 5, line 65, after "contacts" insert --261--.

Column 6, line 12, "is" first occurrence should read --if--.

Signed and Sealed this

*Fourth* Day of *May 1982*

[SEAL]

*Attest:*

GERALD J. MOSSINGHOFF

*Attesting Officer*

*Commissioner of Patents and Trademarks*